US007753213B2

(12) United States Patent
Nogalski

(10) Patent No.: US 7,753,213 B2
(45) Date of Patent: Jul. 13, 2010

(54) COMPOSITE SCREEN

(75) Inventor: James F. Nogalski, Tulsa, OK (US)

(73) Assignee: M-I LLC, Houston, TX (US)

( * ) Notice: Subject to any disclaimer, the term of this patent is extended or adjusted under 35 U.S.C. 154(b) by 0 days.

(21) Appl. No.: 11/692,043

(22) Filed: Mar. 27, 2007

(65) Prior Publication Data

US 2007/0227954 A1 Oct. 4, 2007

Related U.S. Application Data

(60) Provisional application No. 60/787,277, filed on Mar. 30, 2006.

(51) Int. Cl.
*B07B 1/49* (2006.01)

(52) U.S. Cl. ..... 209/405; 209/408

(58) Field of Classification Search ..... 209/395, 209/399, 403, 405, 408
See application file for complete search history.

(56) References Cited

U.S. PATENT DOCUMENTS

| | | | | | |
|---|---|---|---|---|---|
| 4,120,784 | A * | 10/1978 | Hassall | 209/399 |
| 4,486,302 | A * | 12/1984 | Jorgensen | 209/399 |
| 4,563,270 | A * | 1/1986 | Wolff | 209/379 |
| 4,661,245 | A * | 4/1987 | Rutherford et al. | 209/399 |
| 4,674,251 | A * | 6/1987 | Wolff | 52/309.15 |
| 4,832,834 | A * | 5/1989 | Baird, Jr. | 209/397 |
| 4,885,040 | A * | 12/1989 | Wolff | 156/244.18 |
| 5,085,324 | A * | 2/1992 | Dehlen | 209/399 |
| 5,392,925 | A * | 2/1995 | Seyffert | 209/405 |
| 5,735,409 | A * | 4/1998 | Malmberg | 209/399 |
| 5,927,511 | A | 7/1999 | Riddle et al. | |
| 6,070,736 | A * | 6/2000 | Ballman et al. | 209/325 |
| 6,269,954 | B1 * | 8/2001 | Baltzer | 209/405 |
| 6,543,621 | B2 * | 4/2003 | Baltzer et al. | 209/405 |
| 6,672,460 | B2 * | 1/2004 | Baltzer et al. | 209/403 |
| 6,674,975 | B2 | 1/2004 | Yamauchi | |
| 6,685,028 | B1 | 2/2004 | Olsen | |
| 6,715,613 | B2 * | 4/2004 | Eeles et al. | 209/405 |

(Continued)

FOREIGN PATENT DOCUMENTS

WO 0041822 A1 7/2000

OTHER PUBLICATIONS

Official Action dated Feb. 15, 2010, in corresponding Canadian application #2647203. 2 pages.

(Continued)

*Primary Examiner*—Patrick Mackey
*Assistant Examiner*—Mark Hageman
(74) *Attorney, Agent, or Firm*—Osha • Liang LLP

(57) ABSTRACT

A screen support frame for a shale shaker includes a first end, a second end disposed opposite the first end, a first side disposed substantially perpendicular the first and second ends, a second side disposed opposite the first side and a plurality of transverse ribs disposed between the first end and the second end and between the first side and the second side, wherein at least one transverse rib extends downwardly below a lower plane of the screen support frame. A method of forming a screen support frame for a shale shaker includes forming a screen support frame and forming integrally a gasket along a perimeter of a lower plane of the screen support frame.

19 Claims, 5 Drawing Sheets

U.S. PATENT DOCUMENTS

| | | | | |
|---|---|---|---|---|
| 6,759,000 | B2 | 7/2004 | Cook et al. | |
| 7,090,083 | B2 * | 8/2006 | Russell et al. | 209/405 |
| 7,296,685 | B2 * | 11/2007 | Malmberg | 209/405 |
| 7,303,079 | B2 * | 12/2007 | Reid-Robertson et al. | 209/405 |
| 2005/0224398 | A1 * | 10/2005 | Largent et al. | 209/403 |
| 2007/0068853 | A1 * | 3/2007 | Johnson et al. | 209/399 |
| 2007/0125688 | A1 * | 6/2007 | Ballman et al. | 209/405 |

OTHER PUBLICATIONS

Official Action issued in related Eurasian Patent Application No. 200870390; Apr. 6, 2010 (5 pages).

* cited by examiner

COMPOSITE SCREEN

CROSS-REFERENCE TO RELATED APPLICATIONS

This application, pursuant to 35 U.S.C. § 119(e), claims priority to U.S. Provisional Application Ser. No. 60/787,277, filed Mar. 30, 2006. That application is incorporated by reference in its entirety.

BACKGROUND OF INVENTION

1. Field of the Invention

The invention relates generally to oilfield shale shakers. More particularly, the present invention relates to screen frames for oilfield shale shakers.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e. the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use. Further, disposal of drilling mud may present an environmental hazard.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

Apparatus in use today to remove cuttings and other solid particulates from drilling mud are commonly referred to in the industry as "shale shakers." A shale shaker, also known as a vibratory separator, is a vibrating sieve-like table upon which returning dirty drilling mud is deposited and through which clean drilling mud emerges. Typically, the shale shaker is an angled table with a generally perforated filter screen bottom. Returning drilling mud is deposited at the top of the shale shaker. As the drilling mud travels down the incline toward the lower end, the fluid falls through the perforations to a reservoir below leaving the solid particulate material behind. The combination of the angle of inclination with the vibrating action of the shale shaker table enables the solid particles left behind to flow until they fall off the lower end of the shaker table. Preferably, the amount of vibration and the angle of inclination of the shale shaker table are adjustable to accommodate various drilling mud flow rates and particulate percentages in the drilling mud. After the fluid passes through the perforated bottom of the shale shaker, it can either return to service in the borehole immediately, be stored for measurement and evaluation, or it may pass through an additional piece of equipment (e.g. a drying shaker, centrifuge, or a smaller sized shale shaker) to further remove smaller cuttings.

Because shale shakers are typically in continuous use, any repair operations and associated downtimes are to be minimized as much as possible. Often, the filter screens of shale shakers, through which the solids are separated from the drilling mud, wear out over time and need replacement. Therefore, shale shaker filter screens are typically constructed to be quickly and easily removed and replaced. Generally, through the loosening of only a few bolts, the filter screen can be lifted out of the shaker assembly and replaced within a matter of minutes. While there are numerous styles and sizes of filter screens, they generally follow the same design. Typically, filter screens include a perforated plate base upon which a wire mesh, or other perforated filter overlay, is positioned. The perforated plate base generally provides structural support and allows the passage of fluids therethrough while the wire mesh overlay defines the largest solid particle capable of passing therethrough. While many perforated plate bases are generally flat or slightly curved in shape, it should be understood that perforated plate bases having a plurality of corrugated, or pyramid-shaped channels extending thereacross may be used instead. In theory, the pyramid-shaped channels provide additional surface area for the fluid-solid separation process to take place and act to guide solids along their length toward the end of the shale shaker where they are disposed of.

A typical shale shaker filter screen includes a plurality of hold-down apertures at opposite ends of the filter screen. These apertures, preferably located at the ends of the filter screen that will abut walls of the shale shaker, allow hold down retainers of the shale shaker to grip and secure the filter screens in place. However, because of their proximity to the working surface of the filter screen, the hold-down apertures must be covered to prevent solids in the returning drilling fluid from bypassing the filter mesh through the hold-down apertures. To prevent such bypass, an end cap assembly is placed over each end of the filter screen to cover the hold-down apertures. Presently, these caps are constructed by extending a metal cover over the hold down apertures and attaching a wiper seal thereto to contact an adjacent wall of the shale shaker. Furthermore, epoxy plugs are set in each end of the end cap to prevent fluids from communicating with the hold-down apertures through the sides of the end cap.

Typically, screens used with shale shakers are emplaced in a generally horizontal fashion on a generally horizontal bed or support within a basket in the shaker. The screens themselves may be flat or nearly flat, corrugated, depressed, or contain raised surfaces. The basket in which the screens are mounted may be inclined towards a discharge end of the shale shaker. The shale shaker imparts a rapidly reciprocating motion to the basket and hence the screens. Material from which particles are to be separated is poured onto a back end of the vibrating screen. The material generally flows toward the discharge end of the basket. Large particles that are unable to move through the screen remain on top of the screen, and move toward the discharge end of the basket where they are collected. The smaller particles and fluid flow through the screen and collect in a bed, receptacle, or pan beneath the screen.

In some shale shakers a fine screen cloth is used with the vibrating screen. The screen may have two or more overlying layers of screen cloth or mesh. Layers of cloth or mesh may be bonded together and placed over a support, supports, or a perforated or apertured plate. The frame of the vibrating screen is resiliently suspended or mounted upon a support and is caused to vibrate by a vibrating mechanism, e.g. an unbalanced weight on a rotating shaft connected to the frame. Each screen may be vibrated by vibratory equipment to create a flow of trapped solids on top surfaces of the screen for removal and disposal of solids. The fineness or coarseness of the mesh of a screen may vary depending upon mud flow rate and the size of the solids to be removed.

As is illustrated in FIGS. 1A and 1B, a shaker screen 2 is typically installed in, or secured to, the shale shaker 20 with a wedge block 6 and a wedge block retainer bracket 4. The wedge block retainer bracket 4 may be an integral part of the shaker separator and a wedge block 6. The screen 2 is placed in position underneath the wedge block retainer bracket 4 and then the wedge block 6 is pounded into position so as to secure the screen 2 to the shaker separator 20. One of ordinary skill in the art will appreciate that the operator often chooses to use a combination of a hammer and a suitable piece of wood in contact with the wedge block 6 to deliver sufficient force to fully tighten the wedge block 6. During installation of the shaker screen 2 and subsequent tightening of the wedge block 6, the shaker screen 2 is often displaced from its original position. The displaced shaker screen 2 may result in poor sealing between the shaker screen 2 and a sealing surface of the shale shaker 20. If the shaker screen 2 is moved off of the sealing surface, the resulting gap may allow fluid, and therefore cutting particulates, to bypass the screen. Some prior art shale shakers have a hole-and-pin system to secure the position of the shaker screen 2 on the sealing surface of the shale shaker 20 during installation of the shaker screen 2 and tightening of the wedge block 6. However, friction between a rubber seal or gasket disposed on the sealing surface of the shaker screen 2 inhibits moving the screen 2 into position. Additionally, it is common for the pin to tear or damage the gasket, thereby reducing efficiency of the seal.

Accordingly, there exists a need for a shaker screen frame that may be more securely positioned in the shale shaker. Additionally, there exists a need for more efficient sealing of the shaker screen frame to the shale shaker.

SUMMARY OF INVENTION

In one aspect, the present invention relates to a screen frame for a shale shaker, the screen frame including a first end, a second end disposed opposite the first end, a first side disposed substantially perpendicular the first and second ends, a second side disposed opposite the first side and a plurality of transverse ribs disposed between the first side and the second side, wherein at least one transverse rib extends downwardly below a lower plane of the screen frame.

In another aspect, the present invention relates to a screen frame for a shale shaker, the screen frame including a first end, a second end disposed opposite the first end, a first side disposed substantially perpendicular the first and second ends, a second side disposed opposite the first side, a plurality of transverse ribs disposed between the first side and the second side, and a gasket integrally molded with the frame.

In another aspect, the present invention relates to a screen frame for a shale shaker, the screen frame including a first end, a second end disposed opposite the first end, a first side disposed substantially perpendicular the first and second ends, a second side disposed opposite the first side, a plurality of transverse ribs disposed between the first side and the second side, and at least one positioning tab.

In another aspect, the present invention relates to method of forming a screen frame for a shale shaker, the method including forming a screen frame and forming integrally a gasket along a perimeter of a lower plane of the screen frame.

Other aspects and advantages of the invention will be apparent from the following description and the appended claims.

DETAILED DESCRIPTION

In one aspect, embodiments disclosed herein relate to a screen frame for an oilfield shale shaker. Specifically, embodiments disclosed herein relate to a screen frame that may provide more efficient sealing of a screen frame within a shale shaker. Additionally, embodiments disclosed here relate to a screen frame that may limit or reduce displacement of a screen frame during installation of the screen frame. Further, embodiments disclosed herein relate to a method of forming a screen frame.

Figure 1A:
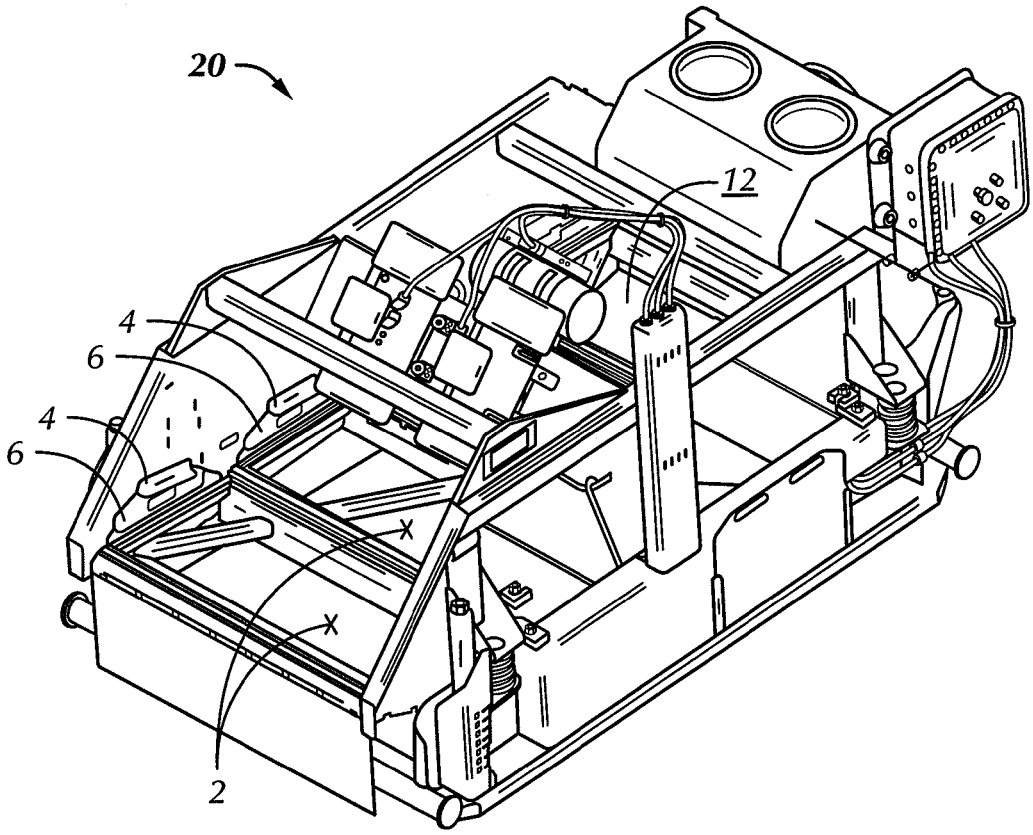
FIGS. 1A and 1B show a conventional shale shaker and wedge block system.
Figure 1B:
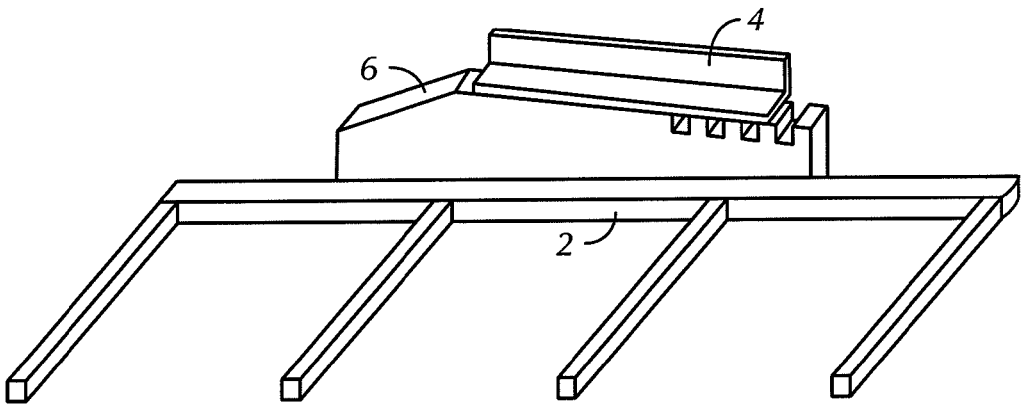
Figure 2:
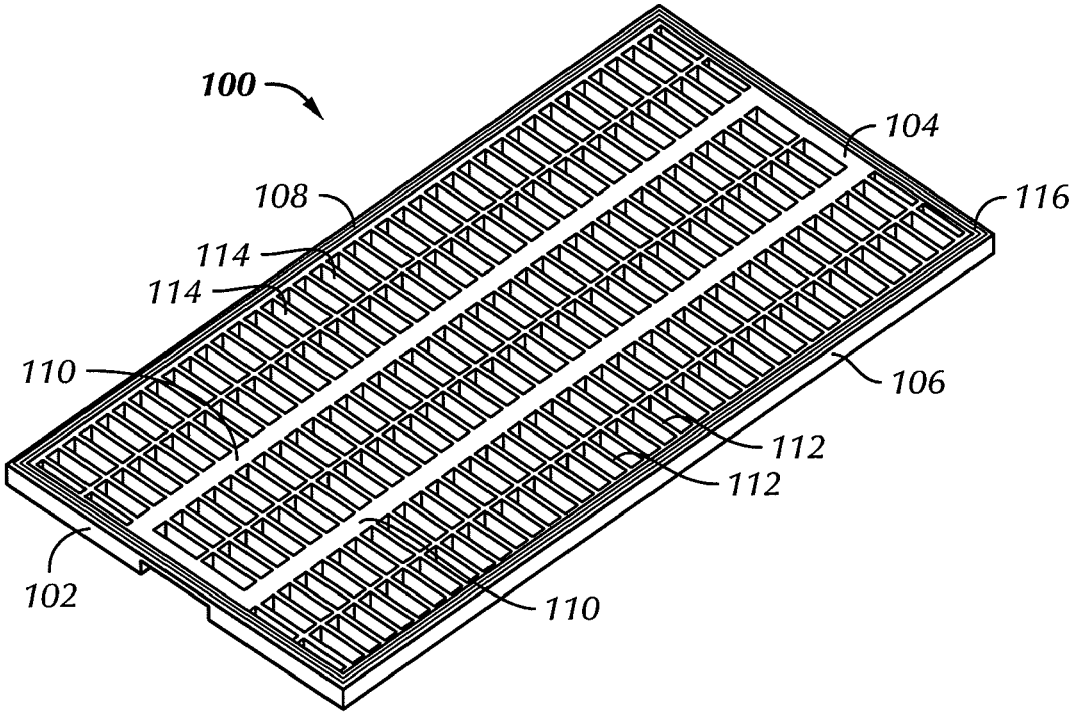
FIG. 2 is a screen frame in accordance with an embodiment of the invention.

Referring initially to FIG. 2, a screen frame 100 for an oilfield shaker in accordance with an embodiment of the present invention is shown. The screen frame 100 has a first side 106 and a second side 108 extending between a first end 102 and a second end 104. At least one longitudinal cross-member 110 may extend between first end 102 and second end 104, disposed between first side 106 and second side 108. A plurality of transverse ribs 112 is arrayed between first end 102 and second end 104 and between first side 106 and second side 108. A plurality of perforations 114 is formed between transverse ribs 112. A fine mesh screen (now shown) may cover perforations 114 such that solid particles larger than a designated mesh size in a slurry flowing across filter screen having screen frame 100 will not pass through.

In one embodiment, screen frame 100 may be formed from any material known in the art, for example, stainless steel, metal alloys, plastics, etc. In a preferred embodiment, screen frame 100 may be formed from a composite material. In this embodiment, the composite material may include high-strength plastic and glass, reinforced with high-tensile-strength steel rods. Composite screen frames may provide more consistent manufacturing of the frame and may more evenly distribute mechanical stresses throughout the screen frame during operation. In another embodiment, screen frame 100 may include composite material formed around a steel or wire frame. The screen frame 100 may be formed by injection molding. U.S. Pat. No. 6,759,000 discloses a method of forming a screen frame by injection molding and is herein incorporated by reference in its entirety. For example, in one embodiment, screen frame 100, having a wire frame and a composite or polymer material, may be formed by first placing a reinforcing wire frame assembly including at least a first end, a second end, a first side, a second side, and at least one cross-member in a mold tool. The mold tool may then be closed and liquid polymer may be injected into the mold tool by injection molding so as to wholly encapsulate the wire frame and to form an article having an open central region crisscrossed by transverse ribs bounded each side of the screen frame 100. An inward force is then exerted on opposite faces of the wire frame assembly within the mold tool by fingers protruding inwardly from inside faces of the mold tool, the fingers being operable to engage the reinforcing wire frame when the mold tool closes. The fingers include inwardly projecting pegs which align with crossing points of wires to space the reinforcing wire frame from corresponding upper and lower internal surfaces of the mold tool and ensure that the reinforcing wire frame is buried within the polymer or composite material which is injected into the mold tool during the manufacturing process. The polymer or composite material is allowed to cure and then the screen frame 100 may be removed from the mold tool.

Figure 3:
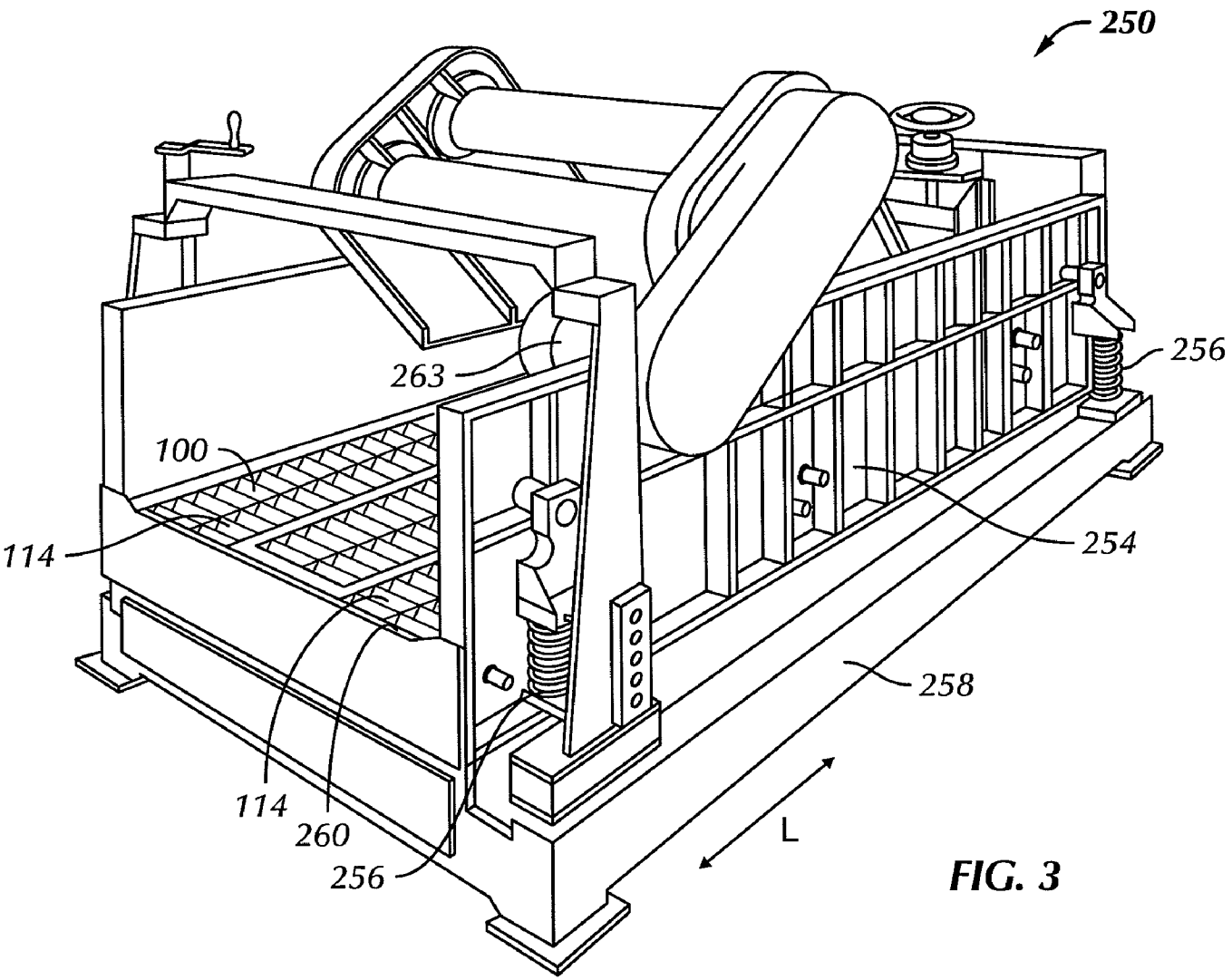
FIG. 3 is a shale shaker in accordance with an embodiment of the invention.

Referring to FIG. 3, in operation, screen frame 100 is installed into a shale shaker 250 on a vibratory screen mounting apparatus or "basket" 254. The screen frame 252 may be any screen frame disclosed herein or have any combination of any feature or features of any screen or screen part disclosed herein; and any such screen may be used with any appropriate shaker or screening apparatus. The basket 254 is mounted on springs 256 (only two shown; two as shown are on the opposite side) which are supported from a frame 258. Those of ordinary skill in the art will appreciate that while certain numbers and locations are provided in embodiments (i.e. springs) a number of combinations and other elements may be used. The basket 254 is vibrated by a motor 263 mounted on the basket 254 for vibrating the basket 254 and screen frame 100. Drilling mud returning from the borehole is washed across a screen mesh (not shown) on screen frame 100 such that the drilling fluid passes through the plurality of perforations 114 and the solids are separated out. Preferably, the shale shaker 250 is inclined such that the solids left behind upon screen frame 100 continue to "flow" along the screen frame upper surface 116 until they fall off an edge 260 of screen frame 100 into a hopper, conveyor belt, or other collection means.

Figure 4:
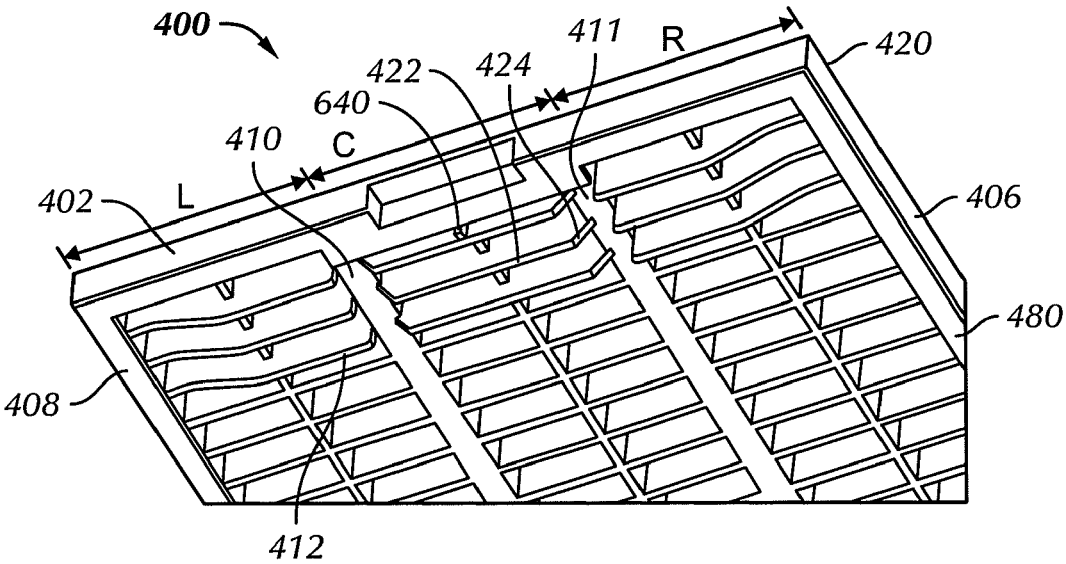
FIG. 4 is a screen frame in accordance with an embodiment of the invention.

In the embodiment shown in FIG. 4, the screen frame 400 includes a first side 406, a second side 408, a first end 402 and a second end (not shown) opposite the first end 402. In this embodiment, two longitudinal cross-members 410, 411 extend from first end 402 to second end (not shown). A plurality of transverse ribs 412 are disposed between first side 406 and second side 408. At least one transverse rib 422 extends downward below a lower plane 420 of the screen frame 400. In one embodiment, at least one downwardly extending transverse rib 422 has at least one sloped portion 424. In one embodiment, at least one downwardly extending transverse rib 422 may be positioned in a central transverse location, indicated at C, between first side 406 and second side 408. In another embodiment, at least one downwardly extending transverse rib 422 may be positioned in a side transverse location, indicated at L and/or R, between first side 406 and second side 408. Alternatively, at least one downwardly extending transverse rib 422 may be positioned proximate first end 402, proximate second end (not shown), and/or at a selected location between first end 402 and second end (not shown).

Figure 5:
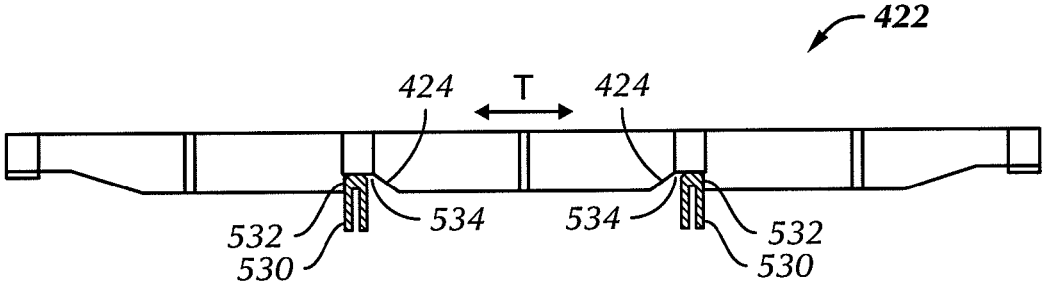
FIG. 5 is a downwardly extending transverse rib of a screen frame in accordance with an embodiment of the invention.

Referring now to both FIGS. 4 and 5, at least one sloped portion 424 of at least one downwardly extending transverse rib 422 is configured to allow screen frame 400 to slide into a screen bay (not shown) of a shale shaker. As screen frame 400 slides into the screen bay, at least one sloped portion 424 contacts a shaker deck rubber 530 disposed on the screen bay of the shale shaker (not shown), thereby moving the screen frame 400 in a predetermined position. A vertical portion 532 of the at least one downwardly extending transverse rib 422 and adjacent sloped portion 424 form a groove 534 configured to receive or engage shaker deck rubber 530. Alternatively, groove 534 may be configured to engage perpendicular mounting rails (not shown) disposed in the shale shaker. Engagement of shaker deck rubber 530 in groove 534 of at least one downwardly extending transverse rib 422 reduces or limits the amount of transverse movement, indicated at T, of the screen frame 400. One of ordinary skill in the art will appreciate that the location of at least one downwardly extending transverse rib and quantity of downwardly extending transverse ribs may be selected in view of, for example, weight limitations of the screen frame, geometry of the shale shaker, location and number of shaker deck rubbers, and/or location and number of mounting rails in the shale shaker.

Figure 6:
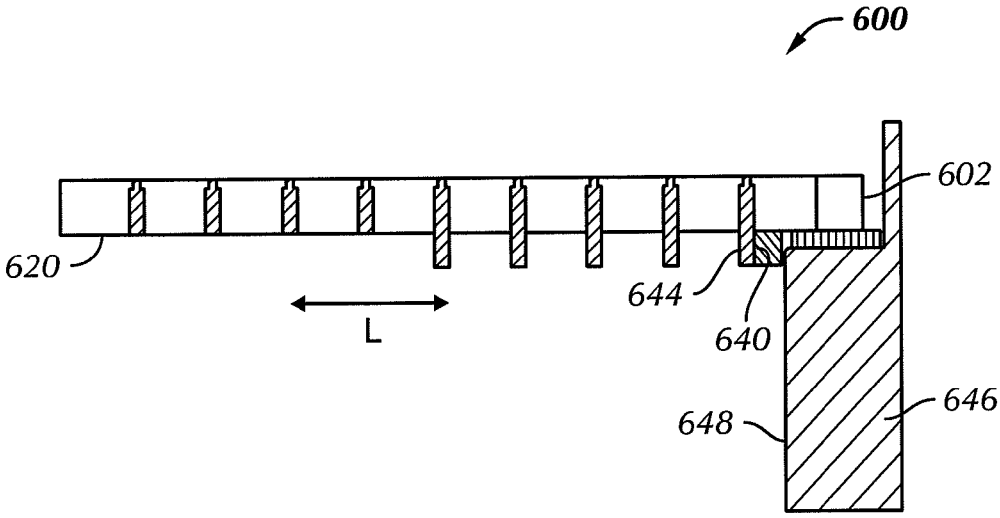
FIG. 6 is a screen frame in accordance with an embodiment of the invention.

In one embodiment, shown in FIG. 6, a longitudinal positioning tab 640 may be disposed proximate first end 602 and/or a second end (not shown) opposite first end 602 of screen frame 600. In this embodiment, longitudinal positioning tab 640 extends downward below lower plane 620 of screen frame 600. In one embodiment longitudinal positioning tab 640 may be disposed between a first downwardly extending transverse rib 644 and first end 602. In one embodiment, longitudinal positioning tab 640 may be integrally formed with first downwardly extending transverse rib 644. When screen frame 600 is installed in screen bay 646, longitudinal positioning tab 640 contacts inner wall 648 of screen bay 646, thereby limiting the amount of longitudinal movement, indicated at L (FIGS. 3 and 6), of screen frame 600.

In another embodiment, shown in FIGS. 7A-7D, a transverse positioning tab 750 may be disposed proximate first side 706 and/or a second side 708 of screen frame (not shown). In one embodiment, transverse positioning tab 750*a* may be disposed on a lower surface 757 of a downwardly extending transverse rib 722*a* proximate first side 706 and/or second side 708. In another embodiment, transverse positioning tab 750 may be disposed on a sloped surface 759 of downwardly extending transverse rib 722*b*. In another embodiment, transverse positioning tab 750*c* may be disposed on a lower plane 720 of transverse rib 712 and extend downwardly therefrom. Transverse positioning tab 750 may be separately or integrally formed with downwardly extending transverse rib 722 or transverse rib 712. One of ordinary skill in the art will appreciate that the size and shape of positioning tab 750 may be selected depending on the geometry and properties of the screen frame, for example, length and width of the screen frame, weight of the screen frame, number of downwardly extending transverse ribs, etc. When the screen frame (not shown) is installed in screen bay 746, transverse positioning tab 750*d* disposed on, for example, a sloped surface 759*d* of downwardly extending transverse rib 722*d*, contacts inner wall 749 of screen bay 746, thereby limiting the amount of longitudinal movement of the screen frame.

Figure 8A:
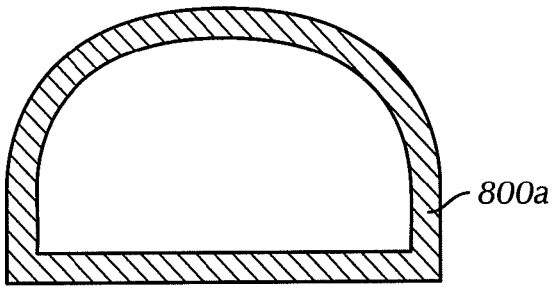
FIGS. 8A and 8B show a gasket for a screen frame in accordance with an embodiment of the invention.
Figure 8B:
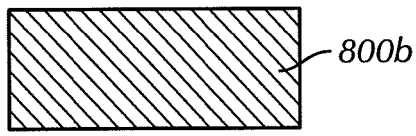
Figure 7A:
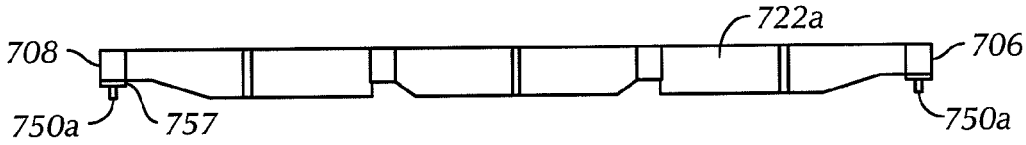
FIGS. 7A-7D show a transverse positioning tab in accordance with an embodiment of the invention.
Figure 7B:
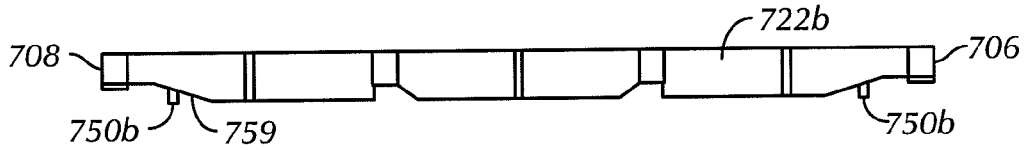
Figure 7C:
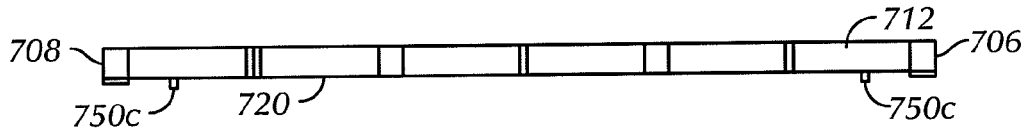
Figure 7D:
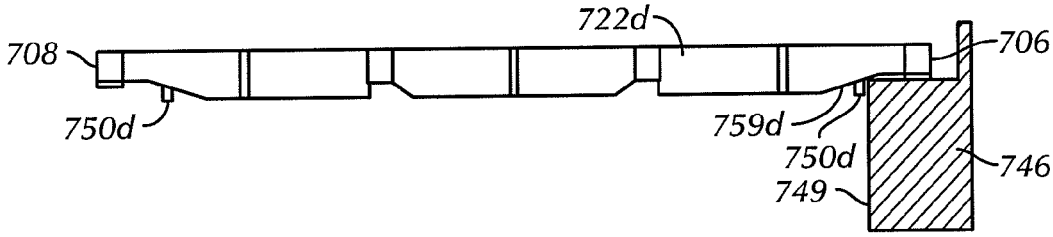

Referring back to FIG. 4, in one embodiment, a gasket, or seal, 480 may be disposed along a perimeter of lower plane 420 of screen frame 400. As used herein, a perimeter of lower plane 420 includes lower surfaces of first end 402, first side 406, second end (not shown), and second side 408. When the screen frame 400 is installed in the shale shaker (not shown), gasket 480 is compressed between the screen frame 400 and a sealing surface (not shown) of the shale shaker, thereby sealing the screen frame 400. As shown in the FIG. 5A, gasket 480 may include a D-shaped, hollow gasket 800*a*. In a preferred embodiment, shown in FIG. 8B, gasket 480 may include a solid gasket 800*b*. In one embodiment, gasket 480 may include a nitrite gasket. In another embodiment, gasket 480 may be formed from a thermoset resin or thermoplastic resin. In one embodiment, gasket 480 may be formed from, for example, polychloroprene or polypropylene. In a preferred embodiment, gasket 480 may include a thermoplastic vulcanizate (TPV). TPVs are high-performance elastomers that combine desirable characteristics of vulcanized rubber, for example, flexibility and low compression set, with processing ease of thermoplastics. TPVs may be injection molded, extruded, blow molded, and thermoformed. One such commercially available TPV is SANTOPRENE™ provided by ExxonMobile Chemical (Houston, Tex.).

In one embodiment, gasket 480 may be coupled to lower plane 420 by any method known in the art. For example, an adhesive may be applied to a surface of gasket 480. In one embodiment, gasket 480 may be formed by injecting a thermoset resin, thermoplastic resin or TPV into a mold. In a preferred embodiment, gasket 480 may be integrally molded with composite screen frame 400. In this embodiment, composite screen 400 may be positioned within a mold tool. Once the mold tool is closed, TPV, for example, may be injected into the mold tool. The TPV is allowed to cure and then the screen frame having an integrally molded gasket 480 on lower plane 420 of the screen frame 400 is removed.

Advantageously, embodiments disclosed herein may provide a more efficient seat for a screen frame for a shale shaker. Additionally, embodiments disclosed herein may improve positioning of a screen frame within a shale shaker. Further, embodiments disclosed herein may prevent displacement of screen frames disposed in a shale shaker during installation of the screen frame and wedge block. Further, embodiments disclosed herein my prevent fluids and drilling particulates from bypassing screen frames disposed in a shale shaker.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A screen support frame for a shale shaker, the screen support frame comprising:

a first end;

a second end disposed opposite the first end;

a first side disposed substantially perpendicular the first and second ends;

a second side disposed opposite the first side; and a plurality of transverse ribs disposed within a perimeter defined by the first end, the second end, the first side, and the second side, wherein at least one transverse rib extends downwardly below a lower plane of the screen support frame, wherein the lower plane is defined by a basal surface of each one of the first end, the second end, the first side, and the second side, and wherein a lower surface of the at least one transverse rib comprises at least one sloped portion along a transverse length.

2. The screen support frame of claim 1, wherein the at least one sloped portion along the transverse length is linear.

3. The screen support frame of claim 1, further comprising at least one longitudinal cross-member.

4. The screen support frame of claim 1, wherein the at least one downwardly extending transverse rib is disposed in a central transverse location of the screen support frame.

5. The screen support frame of claim 1, wherein the at least one downwardly extending transverse rib is disposed in a side transverse location of the screen support frame.

6. The screen support frame of claim 1, wherein the at least one downwardly extending transverse rib is disposed proximate a longitudinal end of the screen support frame.

7. The screen support frame of claim 1, further comprising at least one longitudinal positioning tab.

8. The screen support frame of claim 1 further comprising a gasket disposed along a perimeter of the lower plane.

9. The screen support frame of claim 8, wherein the gasket is one selected from the group consisting of a solid seal and a hollow seal.

10. The screen support frame of claim 8, wherein the gasket is molded with the frame.

11. A screen support frame for a shale shaker, the screen support frame comprising:

a first end;

a second end disposed opposite the first end;

a first side disposed substantially perpendicular the first and second ends;

a second side disposed opposite the first side;

a planar surface defined by a basal surface of each one of the first end, the second end, the first side, and the second side;

a plurality of transverse ribs disposed within a perimeter defined by the first end, the second end, the first side, and the second side, wherein at least a first transverse rib extends downwardly below the planar surface and downwardly below a lower surface of a second transverse rib; and a gasket integrally molded with the frame.

12. A screen support frame for a shale shaker, the screen support frame comprising:

a first end;

a second end disposed opposite the first end;

a first side disposed substantially perpendicular the first and second ends;

a second side disposed opposite the first side;

a plurality of transverse ribs disposed between the first side and the second side, wherein a lower surface of at least one transverse rib has at least one sloped portion along a transverse length, and the at least one transverse rib is configured to extend downwardly below a lower plane defined by co-planar basal surfaces of the first end, the second send, the first side, and the second side; and at least one positioning tab disposed within a perimeter defined by the first end, the second end, the first side, and the second side.

13. The screen support frame of claim 12, wherein the at least one positioning tab is a longitudinal positioning tab disposed inward of the first end of the screen support frame.

14. The screen support frame of claim 12, wherein the at least one positioning tab is a transverse positioning tab disposed inward of the first side of the screen support frame.

15. A method of forming a screen support frame assembly for a shale shaker, the method comprising:

forming a screen support frame, wherein the support frame comprises:

a first end;

a second end disposed opposite the first end;

a first side disposed substantially perpendicular the first and second ends;

a second side disposed opposite the first side; and a plurality of transverse ribs disposed within a perimeter defined by the first end, the second end, the first side, and the second side, wherein at least one transverse rib extends downwardly below a lower plane defined by co-planar basal surfaces of each one of the first end, the second end, the first side, and the second side; and forming integrally a gasket along a perimeter of the lower plane.

16. The method of claim 15, wherein the forming a screen support frame comprises placing a reinforcing wire frame in a mold, injecting a material into the mold, and curing the material, and wherein the at least one transverse rib that extends downwardly below the lower plane comprises a lower surface with at least one linearly sloped portion along a transverse length.

17. The method of claim 16, wherein the material is one selected from the group consisting of polymer and composite material.

18. The method of claim 17, wherein the composite material comprises at least one of plastic and glass.

19. The method of claim 16, wherein the forming integrally a gasket comprises placing the formed screen support frame in a mold, injecting one selected from a group consisting of thermoset resin, thermoplastic resin, and thermoplastic vulcanizate into the mold, and curing the thermoset resin, thermoplastic resin, or thermoplastic vulcanizate.

* * * * *